US009382770B2

(12) United States Patent
Taylor

(10) Patent No.: US 9,382,770 B2
(45) Date of Patent: Jul. 5, 2016

(54) METHANOL STORAGE AND DELIVERY APPARATUS FOR GAS WELLS

(71) Applicant: Arthur Taylor, Hyde Park, UT (US)

(72) Inventor: Arthur Taylor, Hyde Park, UT (US)

( * ) Notice: Subject to any disclaimer, the term of this patent is extended or adjusted under 35 U.S.C. 154(b) by 577 days.

(21) Appl. No.: 13/573,790

(22) Filed: Oct. 3, 2012

(65) Prior Publication Data

US 2013/0092367 A1 Apr. 18, 2013

Related U.S. Application Data

(60) Provisional application No. 61/542,380, filed on Oct. 3, 2011.

(51) Int. Cl.
*E21B 27/00* (2006.01)
*E21B 33/068* (2006.01)

(52) U.S. Cl.
CPC ..... *E21B 27/00* (2013.01); *E21B 33/068* (2013.01)

(58) Field of Classification Search
USPC ..... 166/90.1, 75.11, 75.12; 211/76, 79–84, 211/85.18; 220/560.03, 565, 567, 567.2; 52/32.1, 32.2, 32.4, 32.5
See application file for complete search history.

(56) References Cited

U.S. PATENT DOCUMENTS 487,765 A * 12/1892 Ormerod ..... 211/85.22
1,732,829 A * 10/1929 Boardman ..... 248/146
2,041,320 A * 5/1936 Norquist ..... B60P 3/221 220/DIG. 24
2,746,703 A * 5/1956 Emery ..... 248/150
2,846,078 A * 8/1958 Shelby ..... 211/85
2,903,220 A * 9/1959 Pastor ..... 248/150
2,944,563 A * 7/1960 De Blasio et al. ..... 137/312
2,965,239 A * 12/1960 Rutherford ..... 211/85.18
3,013,757 A * 12/1961 Brammer ..... 248/150
4,175,666 A * 11/1979 Smith ..... 211/85.18
4,245,748 A * 1/1981 Kvamsdal ..... B63B 25/08 114/74 A
4,685,585 A * 8/1987 Robbins ..... B65D 90/105 220/256.1
4,895,272 A * 1/1990 De Benedittis et al. ..... 220/745
5,033,638 A * 7/1991 Cruver et al. ..... 220/571
5,071,166 A * 12/1991 Marino ..... 280/830
5,096,087 A * 3/1992 Thomas ..... 220/561
5,203,386 A * 4/1993 Harp ..... 141/86
5,265,656 A * 11/1993 McGarvey ..... B67D 7/04 137/312
5,273,180 A * 12/1993 Whatley, Jr. ..... 220/565
5,346,093 A * 9/1994 De Benedittis et al. ..... 220/565
5,400,924 A * 3/1995 Brodie ..... 222/108

(Continued)

OTHER PUBLICATIONS

Dictionary definition of "Contain", accessed Nov. 9, 2015 via thefreedictionary.com.*

*Primary Examiner* — Blake Michener
(74) *Attorney, Agent, or Firm* — Thorpe North & Western, LLP

(57) ABSTRACT

A gas well methanol storage and delivery apparatus, includes a housing forming an enclosed interior having a lower portion with a containment container therein and an upper portion, and having at least one door to allow access to the interior. A storage tank mounting structure in the upper portion of the interior above the containment container is adapted to mount a storage tank for storing a supply of methanol. A pump mounting structure also in the interior of the housing above the containment container is adapted to mount a pump for pumping methanol from the storage tank to a gas well for injection into the gas well. Vent means may be provided for allowing natural air flow through a portion of the containment container. The apparatus, with or without a tank and with or without a pump, may be supplied as a prefabricated unit to the well head site.

12 Claims, 8 Drawing Sheets

(56) References Cited

U.S. PATENT DOCUMENTS 5,533,648 A * 7/1996 Read et al. ..... 222/108
5,538,052 A * 7/1996 Harp ..... 141/86
5,688,076 A * 11/1997 Atkins ..... B01D 17/00 166/267
5,752,617 A * 5/1998 Yung ..... 220/571
5,971,009 A * 10/1999 Schuetz et al. ..... 137/312
6,250,345 B1 * 6/2001 Allwein et al. ..... 141/86
8,226,753 B2 * 7/2012 Hebblethwaite ..... 96/155
2008/0206699 A1 * 8/2008 St. Denis ..... F28D 21/0003 432/62
2010/0051281 A1 * 3/2010 Shaw ..... 166/305.1

* cited by examiner (proir art)

METHANOL STORAGE AND DELIVERY APPARATUS FOR GAS WELLS

PRIORITY CLAIM

Priority is claimed to copending U.S. Provisional Patent Application Ser. No. 61/542,380 filed Oct. 3, 2011, which is hereby incorporated herein by reference in its entirety.

BACKGROUND OF THE INVENTION

1. Field of the Invention

The present invention relates generally to natural gas well production apparatus. More particularly, the present invention relates to apparatus for the storage and delivery of methanol to natural gas wells.

2. Related Art

It is current practice to inject methanol into gas wells to reduce, and in most cases prevent, the formation of ice plugs in the well. This requires the placement of chemical tanks in which to store the methanol near the head of each gas well to be treated. These tanks are commonly five hundred gallon chemical storage tanks. The tanks are usually periodically filled with methanol from a tank truck that can travel from tank to tank, and each tank is filled through a hose extending from the truck to the tank. The methanol is then pumped from the tank and into the well by high pressure pumps creating pressures greater than 1000 psi to force the methanol into the wells. The methanol mixes with the gas flowing up the well in sufficient amounts to prevent hydrate formation in the well and wellhead. Hydrate formation in the well and wellhead is generally the cause of the ice plugs. The injection of methanol into the wells generally prevents formation of these ice plugs.

Currently, the chemical tanks for storing the methanol are mounted out of doors near the wellheads. Regulations generally require that the chemical tanks be mounted in a containment container so that any leakage from the tanks can be collected and contained and does not merely flow from the tanks onto and into the ground. The containment containers for possible leakage, when located outdoors, have to have a capacity at least fifty percent more than the capacity of the tank. Thus, with a five hundred gallon tank, the containment container must have a capacity of at least seven hundred and fifty gallons.

Current practice is to place the chemical tank in a cattle watering trough to catch any chemical that spills or leaks from the tank. FIG. 1 shows such a methanol tank installation with chemical tank 1 in a cattle watering trough 2. However, many gas well locations, such as for gas wells in Eastern Utah and in Wyoming, are in remote range land areas where wildlife roam and where cattle roam. Cattle and other animals that roam these areas are accustomed to drinking from such cattle water troughs. By being out of doors, the troughs under the outdoor tanks can collect and fill with water when it rains. Cattle and other animals will drink water from the troughs, and, if chemical has spilled into a trough, it can kill or sicken the cattle or other animals which drink from the contaminated trough. Therefore, currently troughs with chemical tanks mounted therein are usually covered with netting 3 to keep small animals, snakes, and birds from the tough, and are surrounded with railings or other fencing 4 to keep cattle or other live stock and large wild mammals from the trough (again, see FIG. 1). The pumps 5 used to pump the methanol into the wells may be located adjacent the tanks, inside or outside the trough, but within the railings or fencing 4 surrounding the trough. FIG. 1 shows such a pump mounted on and supported just above the ground outside of the trough.

Being out of doors exposes the tanks and pumps to the elements, which can damage the tanks and particularly the pumps. Also, the location of the pumps within the railing or fence and close to the ground can make service and repair of the pumps difficult.

When tanks and pumps are mounted out of doors in these remote areas, they are often used as targets by hunters or others who may also roam these areas, which may result in damage to the tanks and pumps. In addition, the outdoor pumps, which generally cost upwards of two thousand dollars each, become targets for theft.

In addition, in this era of environmental protection, the appearance of chemical storage tanks in a cattle trough with railing or fencing there around, and with associated piping and pumps, can be offensive and objectionable to some. The typical range storage tank and outdoor containment container takes up approximately fifty square feet of space, and, because the containment container it is generally round, the perceived footprint is even larger.

There remains a need for a better system of methanol storage at individual gas well heads.

SUMMARY OF THE INVENTION

In accordance with the present invention, it has been found that a standard five hundred gallon chemical tank can be included in a housing which completely encloses the tank and includes a containment container and mounting for desired pumps and control systems to provide a completely integrated, compact, and enclosed methanol storage and delivery system for gas wells. Since the chemical (methanol) tank is indoors in the housing, rather than outdoors, the capacity of the containment container need only be ten percent more than the capacity of the tank, i.e., five hundred and fifty gallons for the five hundred gallon tank, rather than the fifty percent more or seven hundred and fifty gallons when the tank is located outdoors.

In one example embodiment of the invention, a gas well methanol delivery apparatus includes a housing forming an enclosed interior and having at least one door to allow access to the interior. A containment container is formed in a lower portion of the housing. A storage tank mounting structure is provided in the interior of the housing above the containment container adapted to mount a storage tank within the interior for storing a supply of methanol. A pump attachment plate is also provided in the interior of the housing above the containment container adapted to mount a pump within the interior of the housing for pumping methanol from the tank into the gas well. Vent means are provided for allowing natural air flow through a portion of the containment container.

BRIEF DESCRIPTION OF THE DRAWINGS

Additional features and advantages of the invention will be apparent from the detailed description which follows, taken in conjunction with the accompanying drawing, which illustrates, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT

Figure 1:
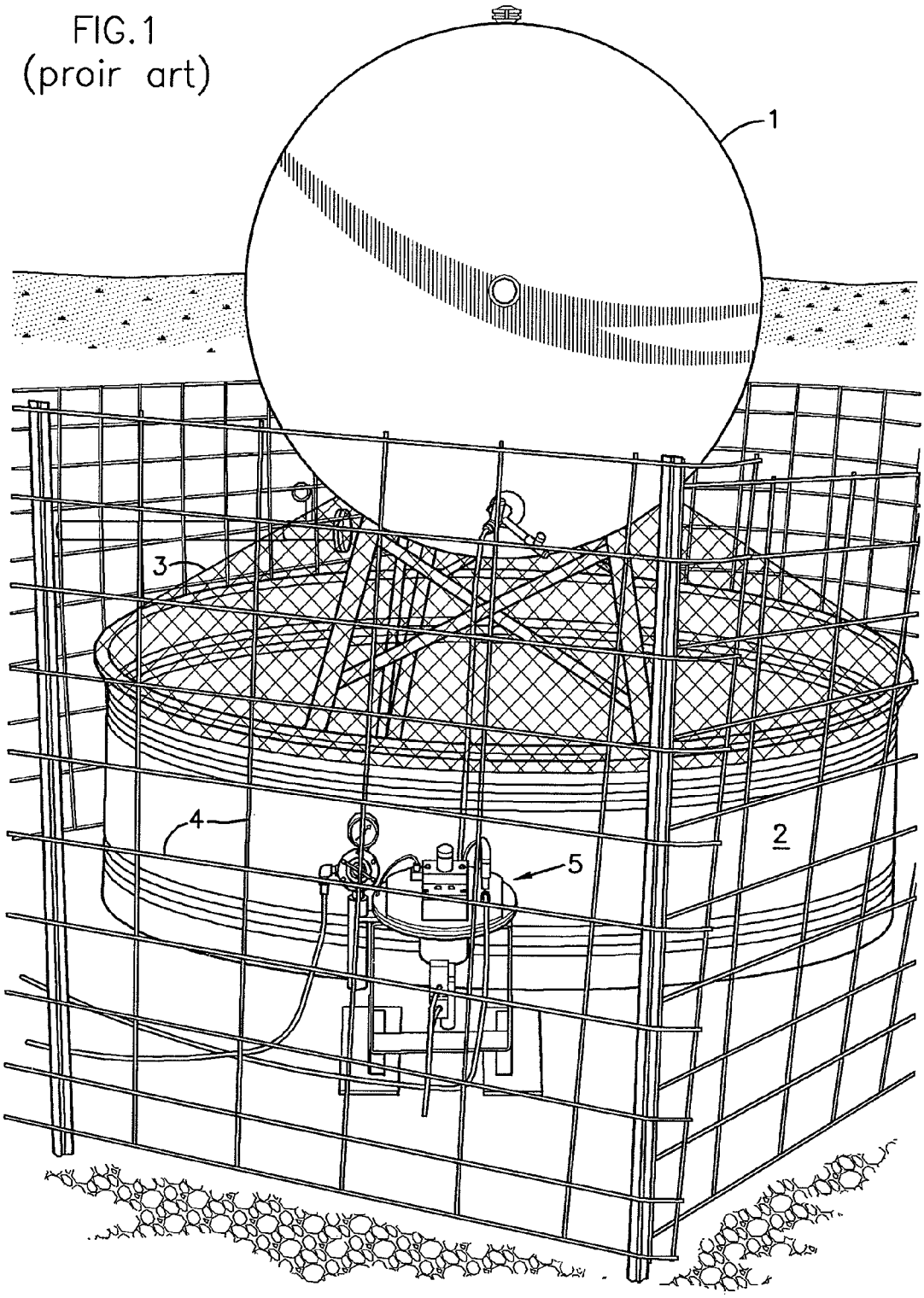
FIG. 1 shows a prior art arrangement of a chemical storage tank mounted outdoors in a cattle trough used as a containment container.
Figure 2:
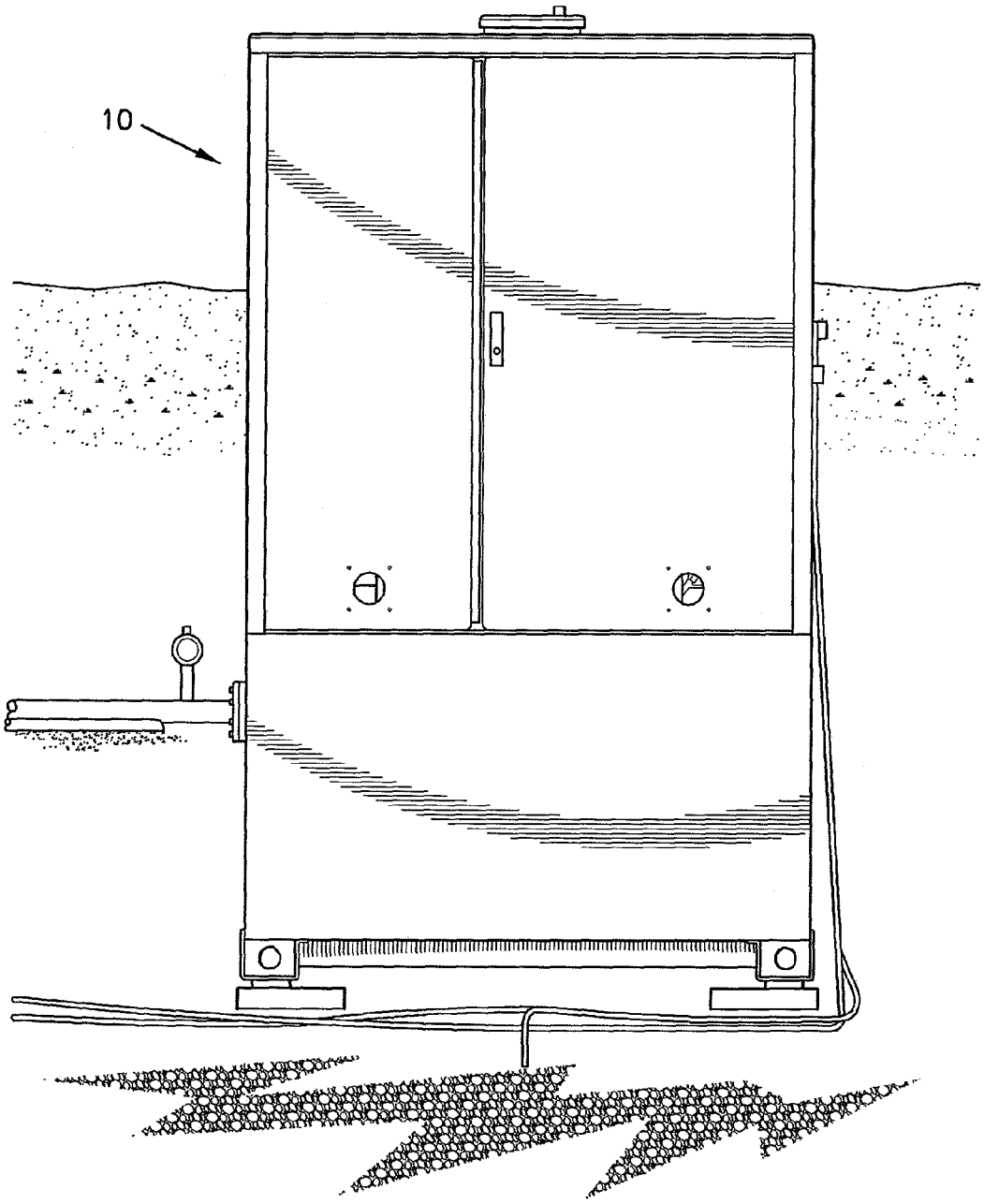
FIG. 2 is a front elevation of a housing of the current invention which replaces the structures and exposed tank and pump of FIG. 1.
Figure 5:
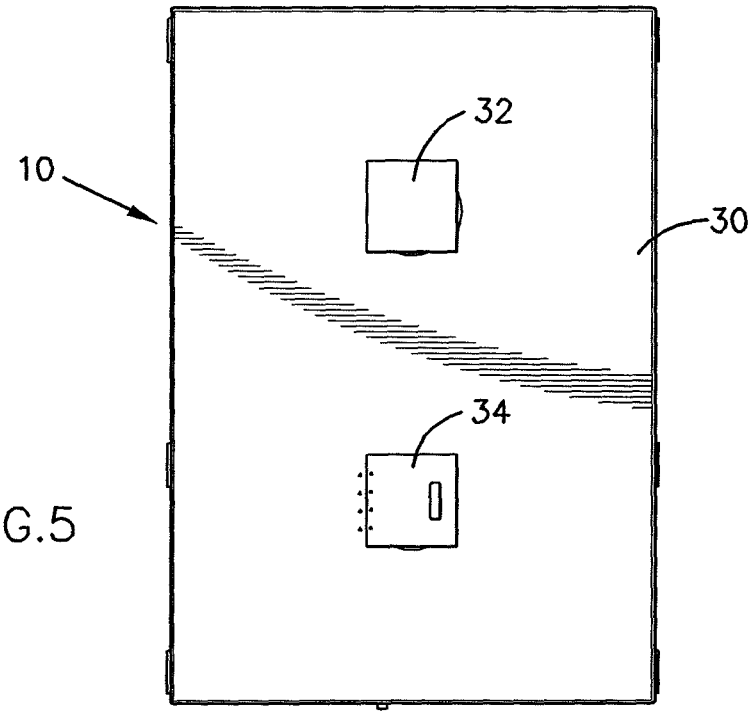
FIG. 5 is a top plan view of the housing of FIG. 3.

The housing of the methanol storage and delivery system of the invention is shown in FIG. 2. The housing 10 contains a tank, containment container, and pump such as shown in FIG. 1 and eliminates the need for the cattle trough, netting, and fencing of the prior art arrangement of FIG. 1. As seen in FIGS. 1 and 2, the apparatus of the invention as shown in FIG. 2 is a smaller and neater installation than that of FIG. 1. Further, the housing hides and provides protection to the tank and pump which is otherwise in open view and substantially unprotected.

Figure 3:
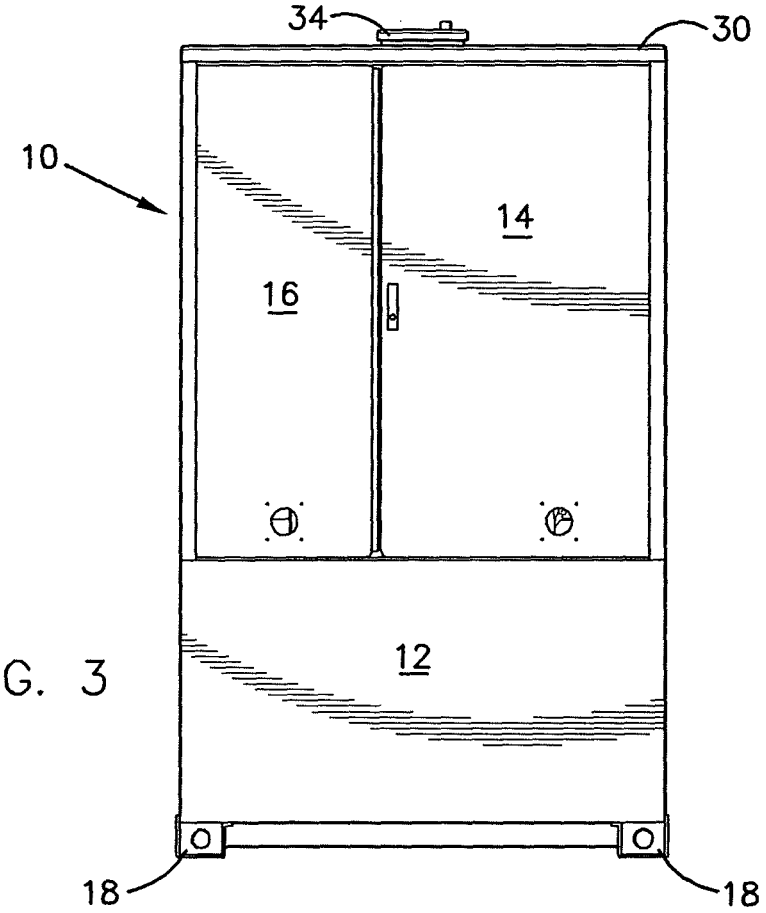
FIG. 3 is a front elevation of the housing of the invention.
Figure 4:
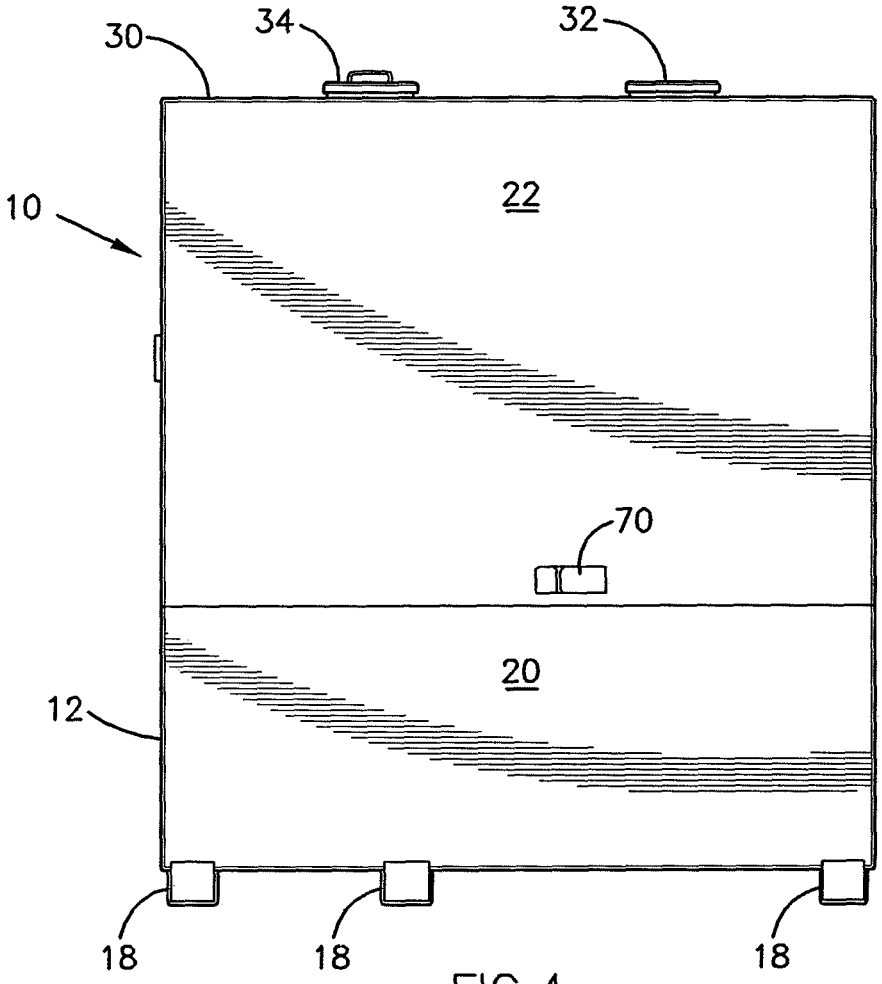
FIG. 4 is a right side elevation of the housing of FIG. 3.

As shown in FIGS. 2-9, the illustrated example embodiment of the apparatus of the invention includes a substantially rectangular housing 10 with a front, FIGS. 2 and 3, including a lower front panel 12 and side-by-side doors 14 and 16 above the lower front panel which provide access to the upper portion of the interior of the housing. Feet 18 extend from the bottom of the housing on opposite sides of the housing. The housing also includes right and left sides, FIGS. 4 and 6, formed by lower side panels 20 and upper side panels 22, and a back, FIG. 8, formed by lower back panel 24 and upper back panel 26. The housing also includes a bottom 28, FIG. 9, and a top or roof 30. Top or roof 30 includes a roof vent 32 and a fill hatch 34.

The front lower panel 12, the two side lower panels 20, the rear lower panel 24, and the bottom 28 are all secured together, such as by welding, to form a sealed, open top, spill containment container 36. In addition, the assembled spill containment container 36 may be galvanized, with the galvanizing zinc coating further ensuring a sealed container and protecting against corrosion. Rather than the lower panels and bottom forming the sealed container, a liner or additional sealed container could be inserted into the interior space created by the lower panels and bottom. Such additional container could be supported by the housing bottom 28 or be otherwise secured and/or supported in the housing in any satisfactory manner.

A storage tank mounting structure is provided in the housing to support a chemical storage tank 38 in the upper enclosed area of the housing above the containment container of the housing. Such a support may take various forms. As shown in the illustrated example embodiment, FIG. 9, such support may include four support legs 40 which rest on the housing bottom 28 substantially above the location of four of the feet 18. Legs 40 extend upwardly and inwardly in the containment container to support and position a tank support and alignment bracket formed by bracket sides 42 and bracket ends 44, with bracket sides 42 attached to the tops of legs 40. A tank support shelf 46 is also supported by legs 40 and, along with storage tank 38, and a pump attachment plate 48, forms the top of the containment container 36. However, this is not a sealed top to the containment container and includes openings into the containment container. In addition to other holes and openings, a pair of vent holes 50 are provided in opposite bracket sides 42 to allow circulation of air into and through the containment container. Chemical storage tank 38 is received in the tank mounting and alignment bracket and tank hold down straps 52 secure tank 38 in the bracket.

Figure 6:
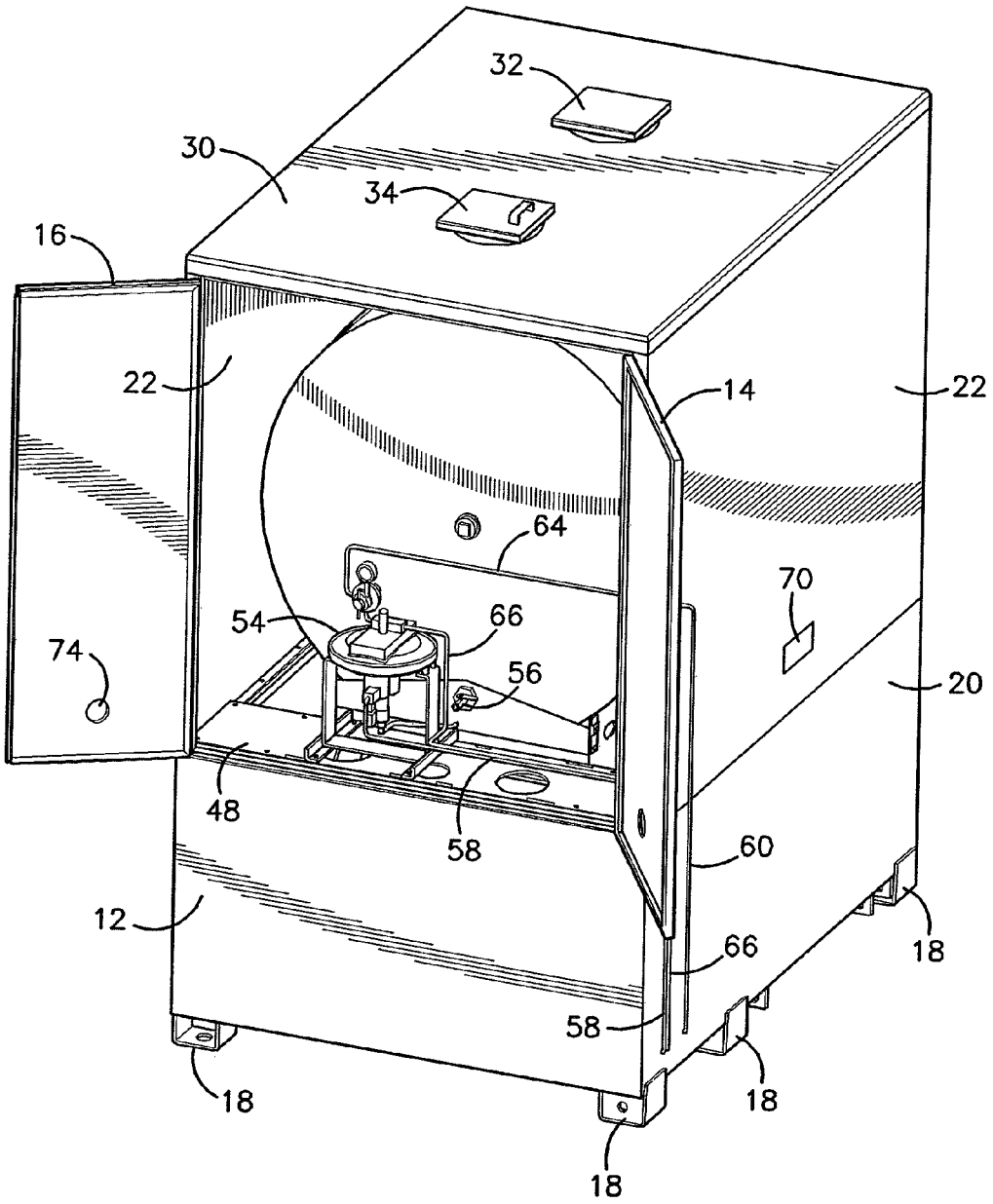
FIG. 6 is a perspective view of the housing of FIG. 3 with the doors open showing a tank and pump mounted in the housing.
Figure 7:
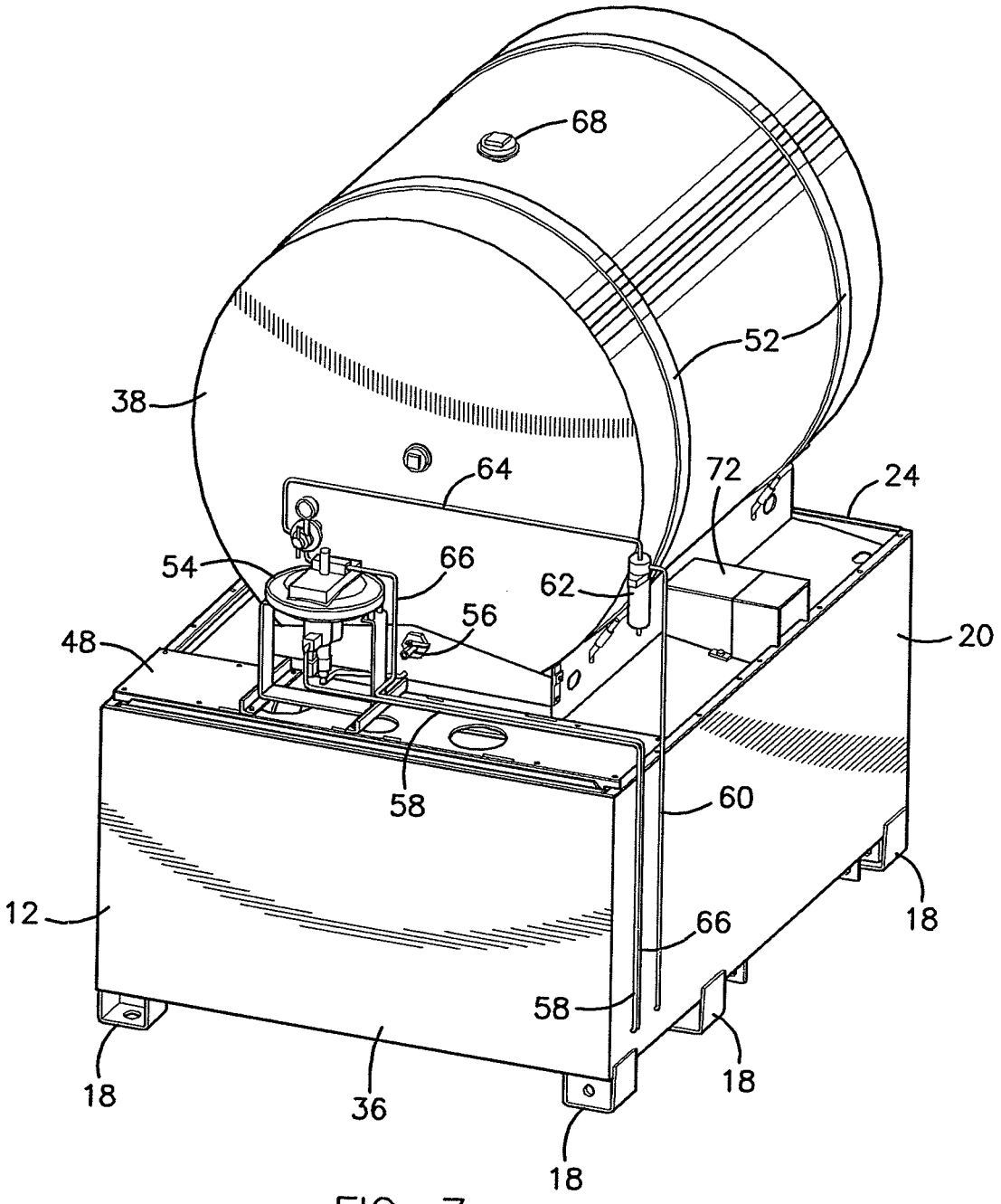
FIG. 7 is a perspective view similar to that of FIG. 6, showing the upper portion of the housing removed.

Pump attachment plate 48 provides a mounting for pump 54, FIGS. 6 and 7. The inlet of pump 54 is connected to tank outlet 56 in usual manner through a pipe or tube, not shown, so that pump 48 pumps methanol from tank 38, at high pressure necessary to pump the methanol down a gas well, through the outlet pipe 58 from pump 54 which extends to the wellhead, not shown, of the gas well to be treated. The pump illustrated in this embodiment is a diaphragm pump, but various other types of pumps satisfactory to pump the methanol at high pressure from the tank to the well head, may be used. The diaphragm pump shown is powered by high pressure gas drawn off from the well. With many gas wells, the gas comes from the well at pressures between five hundred and three thousand PSI. Some of this high pressure gas can be bled off from the gas coming from the well and used to power the diaphragm pump and then can be used for other purposes such as being sent to a heater to heat the gas lines, if necessary. In such cases, inlet gas line 60 comes into the housing and to a gas drier 62, FIG. 7, and connects to the pump 54 through gas line 64. This gas, after passing through and powering the pump, flows from the pump and housing through gas outlet line 66. Rather than the diaphragm pump shown, an explosion proof electrical pump can be used. In such case, the pump can be powered by electricity from batteries, not shown, which are charged by solar panels, also not shown, which can be located on the housing roof, on a stand near the housing, or otherwise supported to receive sunlight. If the housing is near a power grid, power from the power grid can be used rather than using a solar power system. However, when the wellhead is located in a remote area, as is often the case, power from a power grid is not available so gas from the well or a solar power system is used. Any pump controls or other controls for the apparatus, not shown, but known in the industry, are also located in the housing.

As illustrated, pump 54 is located in the housing which shelters the pump from UV radiation from the sunlight and reduces the likelihood of pump problems. UV radiation can damage many of the components in a pumping system. In addition, the pump is positioned in the housing at approximately waist height and adjacent doors 14 and 16 to make servicing of the pump much easier than when the pump is mounted on the ground behind fencing as shown in FIG. 1.

Figure 8:
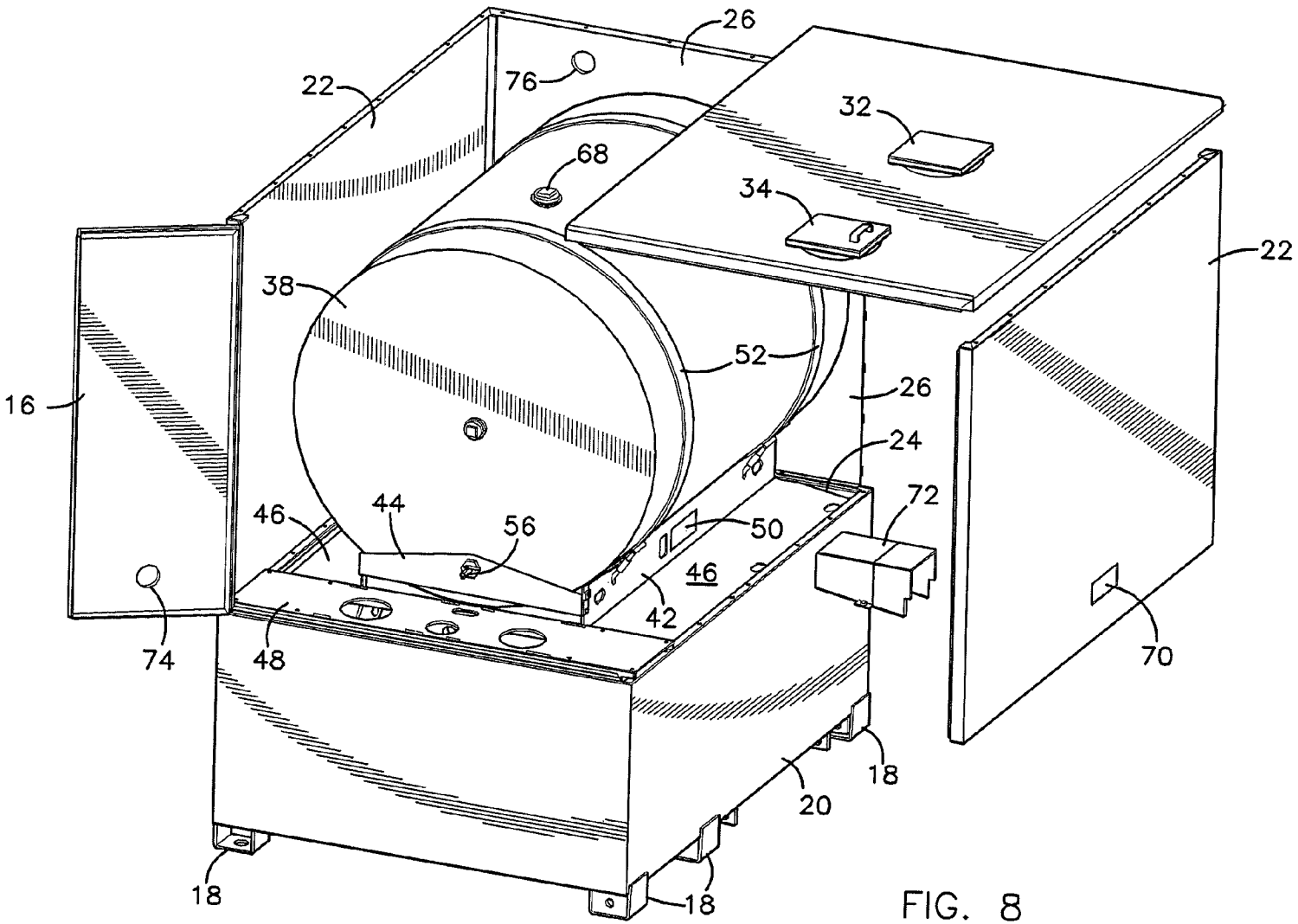
FIG. 8 is also a perspective view similar to that of FIG. 6, showing the upper portion of the housing in partially exploded view.
Figure 9:
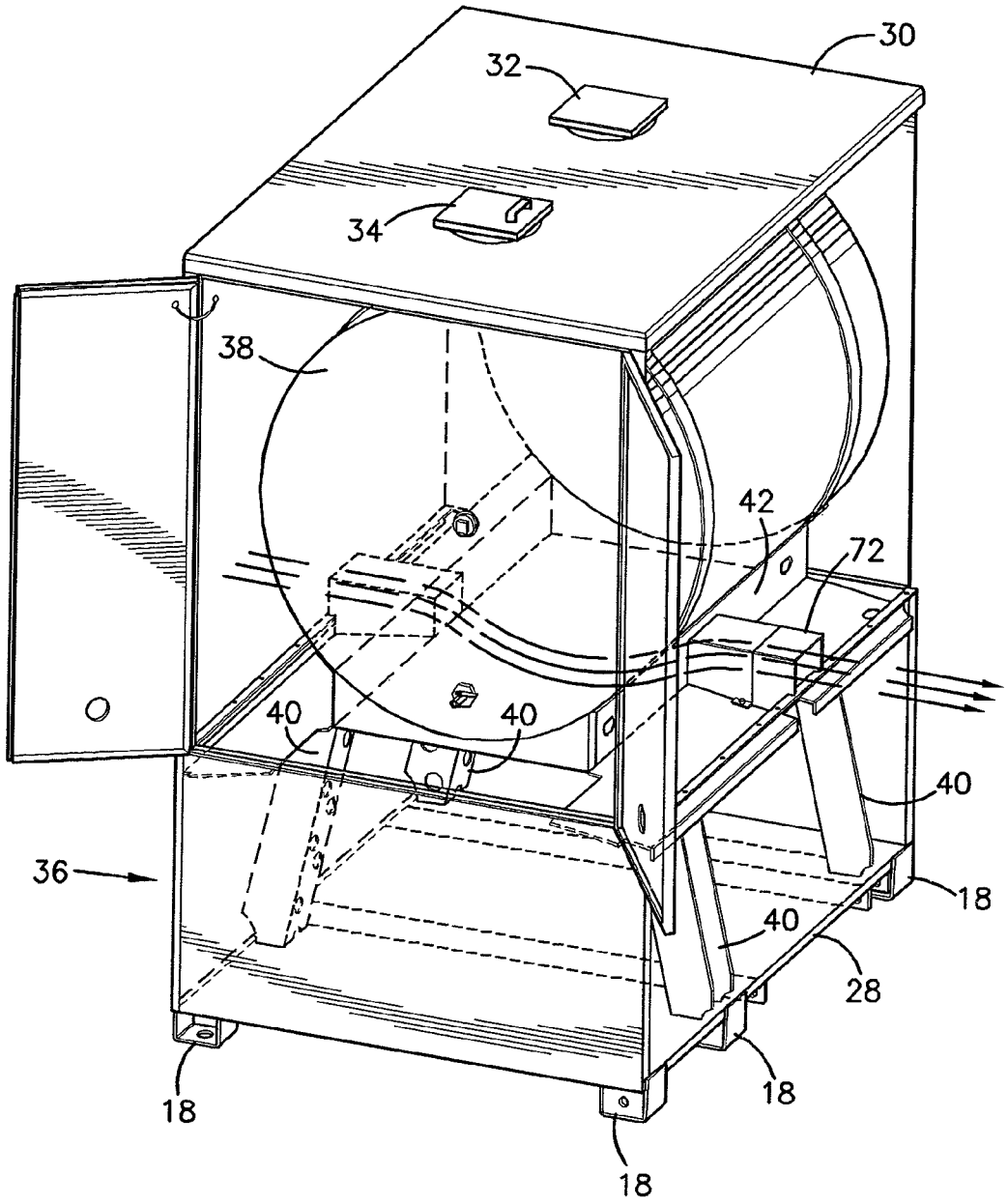
FIG. 9 is a still further perspective view similar to that of FIG. 6, showing interior details and the flow of air through the containment container.

Tank 38 will generally include an inlet opening 68, FIGS. 7 and 8, through which liquid methanol is added to the tank when necessary to replenish the supply of methanol in the tank. The inlet opening 68 will generally have a cap, but the methanol is not under pressure in the tank. The inlet to the tank will generally be provided at the top of the tank as positioned in the housing, directly under the fill hatch 34, FIG. 6, so that for filling the tank, the fill hatch 34 is opened and the supply hose is inserted through the tank inlet 68 and the tank is filled. Liquid methanol will start to vaporize above about sixty degrees F. Therefore, when the methanol tank is located outdoors in sunlight, particularly in hot climates, the sunlight will heat the tank and methanol therein, causing substantial quantities of the methanol to vaporize and flow from the inlet of the tank. When the tank is located in the housing of the invention, it is shielded from direct sunlight so is not heated by the direct sunlight. It has also been found that the methanol from the tank itself will cool the housing. Thus, protecting the methanol storage tank from direct sunlight by placing it in the housing of the invention dramatically lowers the evaporation rate of the methanol from the tank, thus reducing methanol consumption and thereby saving money and increasing the length of time between necessary refilling of the tank. This is a further unexpected advantage of the invention.

Because of the flammability of methanol vapors, it is undesirable to allow the vapors to build up excessively in the lower portion (the containment container) of the housing. It has been found that by providing the pair of vent holes 50 which open directly into the containment container on opposite sides 42 of the tank holding bracket, FIG. 8, and by providing corresponding vent holes 70 through the upper side panels 22 with connecting ducting 72 between the respective vent holes 70 and vent holes 50, a natural flow of atmospheric air from outside the housing through the containment container is achieved that will ventilate the containment container and remove excessive methanol vapors. This allows ventilation of the containment container without requiring holes of any kind through the sealed walls or bottom of the containment container. Further ventilation openings in the upper housing, such as openings 74 in the housing doors, FIG. 8, and openings 76 in the housing back upper back panel 26, as well as roof vent 32, allow atmospheric ventilating air to flow into the upper enclosed area of the housing.

The housing of the invention, with the methanol storage tank and the pump installed in the housing, can be prefabricated and easily moved to the wellhead site for installation, or can be easily moved from one wellhead site to another without disassembly. The housing can easily be picked up and moved with a forklift, or picked up and placed on a truck and picked up from the truck and placed at a desired location at a wellhead site by a fork lift. This can save a great deal of expensive field labor and speeds up installation. In a retrofit situation, the unit of the invention is virtually a plug and play replacement. In the illustrated embodiment using a standard five hundred gallon chemical storage tank, the housing can be fifty six inches wide and seventy eight inches long. The height of the housing can be eighty eight inches with an additional three inches added by the feet 18.

With the housing of the invention, the chemical storage tank, pumping system, and containment container are all completely enclosed. This protects wildlife of all sorts which gravitate to the commonly used prior art cattle trough containment containers as a possible source for water. The containment container in the lower portion of the housing is virtually impossible to access by an animal even if the doors of the housing are left open as the pump mounting plate and the tank mounting configuration block an animal's ability to drink from the containment container. Further, the housing of the invention takes up only about thirty square feet of space. This is about a forty percent reduction over the commonly used prior art cattle trough containments. The enclosed nature of the apparatus eliminates the appearance of chemical tanks and helps eliminate what some feel is an unsightly menagerie of pumps, tanks, cattle troughs, netting, and fencing in sensitive environments which can create poor perceptions in the eyes of the public. These items are replaced with a nice tidy little housing having a smaller footprint and a host of positive features. In the housing, the chemical contents are unknown to visitors in open spaces. This can be a very important public relations tool. In addition, the housing can be locked if threats of theft exist and the enclosed nature of the system prevents would-be thieves from even seeing the valuable equipment within the housing in the first place.

While the forgoing example is illustrative of the principles of the present invention in one or more particular applications, it will be apparent to those of ordinary skill in the art that numerous modifications in form, usage, and details of implementation can be made without the exercise of inventive faculty, and without departing from the principles and concepts of the invention. Accordingly, it is not intended that the invention be limited, except as by the claims set forth below.

The invention claimed is:

1. A housing structure for a gas well methanol storage and delivery apparatus, comprising:

a housing forming an enclosed interior having a lower portion and an upper portion and said housing having at least one door to allow access to the interior;

a containment container formed in the interior of the lower portion of the housing;

a storage tank mounting structure in the interior of the housing above the containment container adapted to mount a storage tank within the interior of the upper portion of the housing for storing a supply of methanol;

vents for allowing natural air flow through a portion of the containment container; and wherein the housing is a rectangular housing having two opposite sides, and wherein the vents through the housing include at least one vent opening through each of the opposite sides.

2. A housing structure for a gas well methanol storage and delivery apparatus according to claim 1, wherein the vents additionally include ducting extending between respective vent openings through the housing and vent openings through the storage tank mounting structure.

3. A housing structure for a gas well methanol storage and delivery apparatus according to claim 1, wherein the vents include vent openings through the storage tank mounting structure into the containment container.

4. A housing structure for a gas well methanol storage and delivery apparatus according to claim 1, wherein the storage tank mounting structure includes a tank receiving cradle adapted to receive a storage tank thereon.

5. A housing structure for a gas well methanol storage and delivery apparatus according to claim 4 additionally including a storage tank mounted on the tank receiving cradle.

6. A housing structure for a gas well methanol storage and delivery apparatus according to claim 5, wherein the storage tank mounting structure, in combination with the storage tank mounted on the tank receiving cradle, form a top for the containment container.

7. A housing structure for a gas well methanol storage and delivery apparatus according to claim 4, additionally including a pump mounting structure in the interior of the housing above the containment container adapted to mount a pump within the interior of the upper portion of the housing for pumping methanol from the storage tank to a gas well for injection into the gas well.

8. A housing structure for a gas well methanol storage. and delivery apparatus according to claim 7, additionally including a pump mounted on the pump mounting structure.

9. A housing structure for a gas well methanol storage and delivery apparatus according to claim 1, additionally including a storage tank mounted on the storage tank mounting structure.

10. A housing structure for a gas well methanol storage and delivery apparatus according to claim 9, wherein the storage tank mounting structure, in combination with the methanol storage tank mounted on the storage tank mounting structure, form a top for the containment container.

11. A housing structure for a gas well methanol storage and delivery apparatus according to claim 1, additionally including a pump mounting structure in the interior of the housing above the containment container adapted to mount a pump within the interior of the upper portion of the housing.

12. A housing structure for a gas well methanol storage and delivery apparatus according to claim 11, additionally including a pump mounted on the pump mounting structure.

* * * * *